United States Patent [19]

Collier et al.

[11] Patent Number: 4,490,084

[45] Date of Patent: Dec. 25, 1984

[54] WIRE TRANSFER MECHANISM

[75] Inventors: John C. Collier, York; Richard H. Davis, Marysville, both of Pa.

[73] Assignee: Burndy Corporation, Norwalk, Conn.

[21] Appl. No.: 209,247

[22] Filed: Nov. 21, 1980

[51] Int. Cl.[3] ..... B65H 57/26

[52] U.S. Cl. ..... 414/222; 414/740; 414/680

[58] Field of Search ..... 198/638; 414/222-226, 414/740, 745, 748, 80, 680, 729-733, 736, 738, 739, 744 R, 744 A; 29/748, 759, 753, 760; 294/104

[56] References Cited

U.S. PATENT DOCUMENTS

| | | | |
|---|---|---|---|
| 1,626,410 | 4/1927 | Halstead | 414/740 |
| 3,104,765 | 9/1963 | Campbell et al. | 414/740 |
| 3,157,911 | 11/1964 | Campbell et al. | 414/740 X |
| 3,245,135 | 4/1966 | Netta et al. | 29/748 |
| 3,537,702 | 11/1970 | Kosrow et al. | 414/740 X |
| 3,707,756 | 1/1973 | Wolyn | 29/748 |
| 3,893,358 | 7/1975 | Dixon | 198/638 |
| 3,913,751 | 10/1975 | Friedman | 414/680 |
| 4,148,161 | 4/1979 | McCandless et al. | 414/740 X |

FOREIGN PATENT DOCUMENTS

| | | | |
|---|---|---|---|
| 61080 | 3/1955 | France | 198/638 |

*Primary Examiner*—Robert J. Spar
*Assistant Examiner*—Terrance L. Siemens
*Attorney, Agent, or Firm*—Howard S. Reiter

[57] ABSTRACT

A wire transfer mechanism for transporting a length of wire conductor from a feed location to a terminating location and then depositing the length of wire at a collection location is disclosed. The mechanism includes at least one transfer arm mounted for pivotable motion back and forth; a releasable gripper mechanism positioned at the end of each transfer arm for gripping a length of wire to inhibit relative motion in a direction normal to the axis of the wire, and an actuator mechanism for releasing the gripper mechanism while the transfer arms move from a wire terminating position to a wire pickup position at a finite velocity and for decelerating the transfer arms, so that the momentum of a wire gripped in the gripper mechanism will carry it away from the transfer arms in a direction normal to the axis of the wire.

5 Claims, 10 Drawing Figures

10
11
12
12
13
13

3-WAY DIVERTER VALVE
16
DOUBLE ACTING AIR CYLINDER
41
LINE
FILTER LUBRICATOR REGULATOR
41
5-PORTED 4-WAY VALVE
3-WAY NORMALLY CLOSED VALVE
19

WIRE TRANSFER MECHANISM

BACKGROUND OF THE INVENTION

I. Field of the Invention

The present invention relates to a mechanism for transporting a length of wire from one position to another, and more particularly to an improved automatic wire transfer mechanism that is adapted to be used with and move a section of wire from a cutting and stripping machine to a wire crimping press, and thereby form a complete wire lead making unit.

II. Description of the Prior Art

In many of the typical apparatus that include systems for cutting, stripping and/or crimping wire leads, (electrical conductors), there is also included along with the wire transferring mechanism some sort of apparatus or mechanism for straightening a length of wire. A wire straightening apparatus is usually required because when wire leads are processed, and then transported from one location to another by a wire transfer mechanism there is a tendency to cause bending of the wire. When dealing with electrical wire conductors, it is rather obvious that bending of the wire leads during processing is highly undesirable. However, including a wire straightening apparatus in a system for processing electrical wire leads is also undesirable. This type of equipment generally decreases the efficiency of the overall system while increasing the overall cost thereof. In U.S. Pat. No. 3,707,756 there is illustrated a wire positioner for a terminal attaching machine which is an example of the kind of attempts illustrated by the prior art to avoid the use of a wire straightening mechanism.

SUMMARY OF THE INVENTION

It is therefore an object of the present invention to overcome some basic disadvantages of wire transferring systems described in the prior art, and to provide a wire transfer mechanism that is adapted to be operated in conjunction with a wire cutting apparatus, a stripping machine and a crimping press in a manner which minimizes the possibility of bending the length of wire that is being processed by the system.

It is another object of this invention to employ a wire transferring mechanism which operates in a fast and highly efficient manner, and one that is readily adaptable for processing electrical wire conductors in a mass production system.

It is a further object of the present invention to provide a wire transfer mechanism which in addition to having the above-described advantages, is simple in design, easy to operate, and relatively inexpensive.

The foregoing objects and others and accomplished in accordance with the present invention by providing a wire transfer mechanism for transporting a length of wire conductor from a feed location to a terminating location and then depositing the length of wire at a collection location, the mechanism comprising a base that is positionable relative to wire feed assemblies and wire terminating assemblies; a tranfer arm pivoted proximate one end thereof to the base, the arm being pivotable back and forth between a pick up position and a termination position; means for moving the transfer arm back and forth at selected intervals coinciding with the operation of a crimping machine and a wire feed machine; releasable gripper means located proximate at the other end of the transfer arm for gripping a length of wire to inhibit relative motion thereof in a direction normal to the axis of the wire; and actuator means for releasing the releasable gripper means while the transfer arm is moving from the termination position to the pick-up position at a finite velocity and for decelerating the transfer arm, whereby the momentum of a wire gripped in the gripper means will carry it away from the transfer arm in a direction normal to the axis of the wire.

BRIEF DESCRIPTION OF THE DRAWINGS

For a better understanding of the invention as well as other objects and further features thereof, reference is made to the following detailed disclosure of this invention taken in conjunction with the accompanying drawings wherein.

FIGS. *2a, 2b, 2c, 2d, 2e, 2f, 2g,* and *2h* illustrate schematic top views of the various operational positions of the wire transfer mechanism shown in FIG. 1, the mechanism positioned in a complete wire lead making system.

DESCRIPTION OF THE PREFERRED EMBODIMENTS

Figure 1:
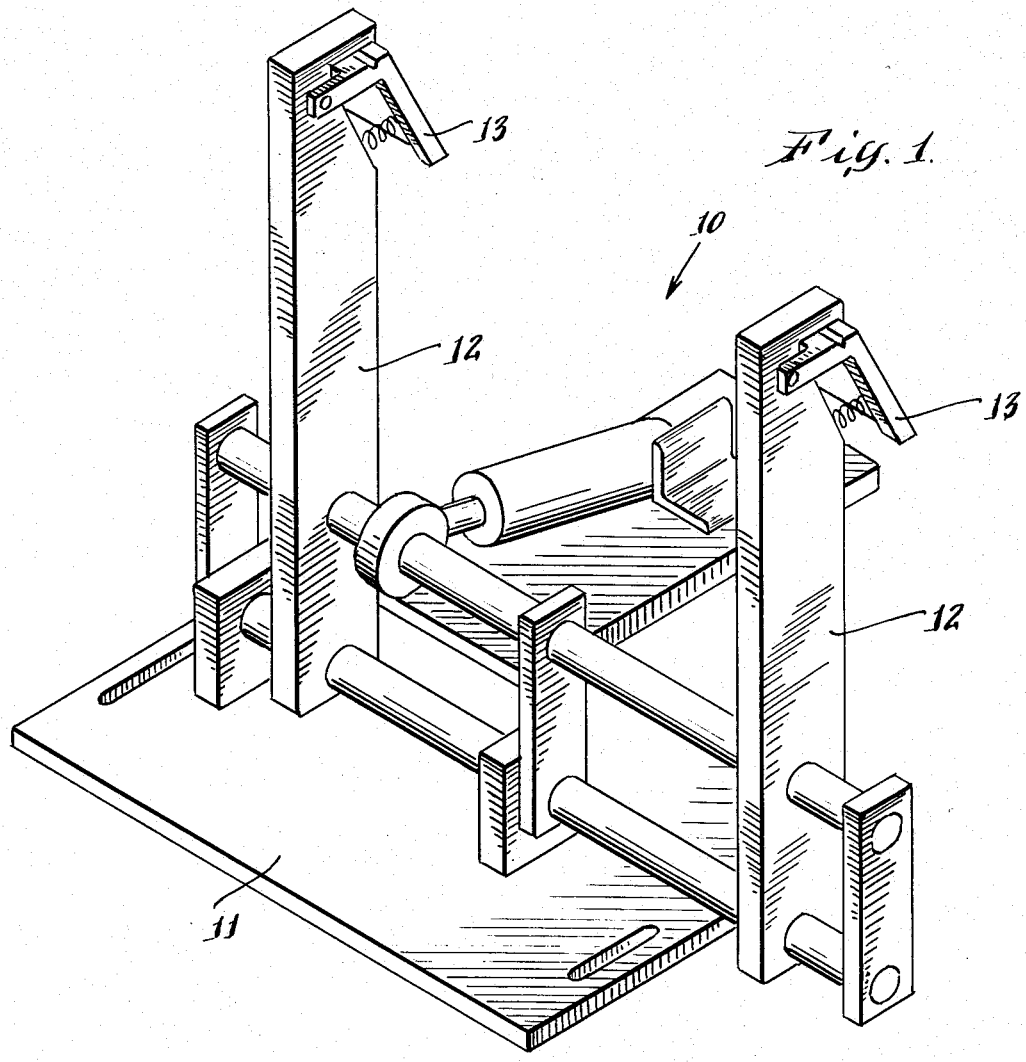
FIG. 1 illustrates a perspective view of a preferred embodiment of an automatic wire transfer mechanism in accordance with the present invention.

Referring now to the drawings and particularly to FIG. 1 thereof there is shown a preferred embodiment of an automatic transfer mechanism in accordance with the features of the present invention. As described hereinbelow, the automatic wire transfer mechanism 10 can be used to link a conventional wire cutting and stripping machine to a crimping press to form a complete wire lead making unit. When mounted in such a system, the wire transfer mechanism in accordance with the present invention can transfer a measured, cut and stripped wire to the crimping area of a press for the subsequent application of a strip fed terminal to the wire. Terminated at one end thereof, the wire leads would then be delivered to a stacking tray. In particular, the basic overall features of the automatic transfer mechanism 10 include a base portion 11, transfer arms 12 that are pivotedly connected at one end thereof to base portion 11 such that they are capable of movement in a pivotable back and forth motion between several positions, and releaseable gripper means, preferably in the form of releaseable gripper jaws 13, positioned at each of the other ends of transfer arms 12 for gripping a length of wire in a manner which prevents relative motion of the wire in a direction normal to the axis of the wire, but permits axial motion thereof. During operation, gripper jaws 13 open affirmatively while arms 12 rotate at finite velocity so that the forward motion of the jaws carries a completed lead wire out of the jaws, which are then ready for the next cycle. To receive the next length of wire, jaws 13 open by the engagement of a stop mechanism which advances to meet transfer arms 13 early in their return stroke and to open jaws while the return stroke continues, and then retreats with the transfer arms so that the jaws close after a new wire is engaged. All of these steps occur in a continuously repeatable sequence. Although the particular preferred embodiment of the automatic wire transfer mechanism in accordance with the invention as illustrated in the drawings shows a mechanism having two transfer arms 12, it is to be understood that is is within the scope of the present invention to employ one, two, three or more transfer arms 12 having releaseable gripper means, with the automatic wire transfer mechanism described herein.

Figure 2A:
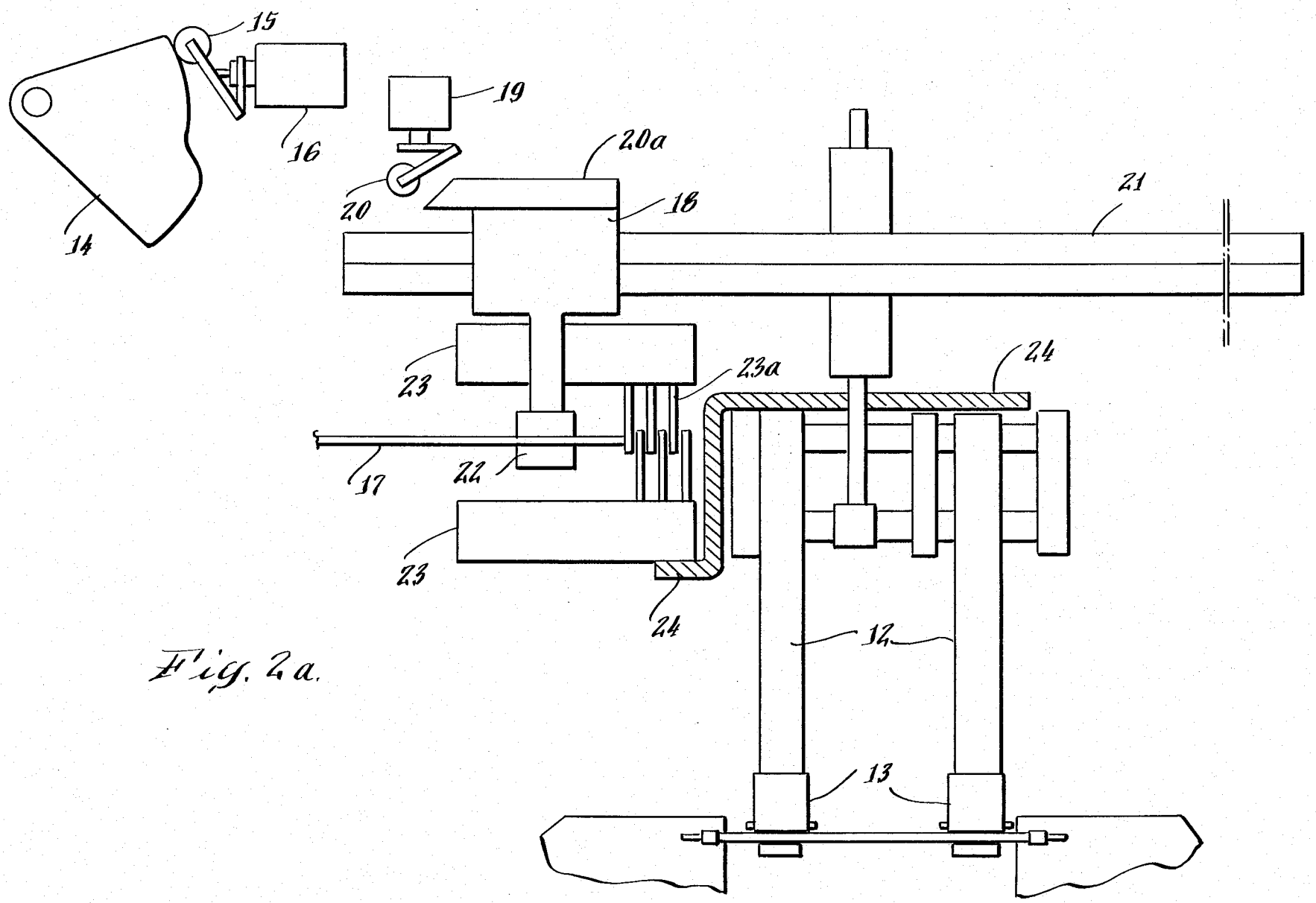

Referring now to FIG. 2*a* there is shown in a static position a wire lead making unit including quadrant cam 14 that engages via cam follower 15 valve 16 which controls downward (forward) motion, i.e. moves transfer arms 12 to the crimp position. Valve 16 is actuated by the release of wire 17 from wire pulling head 18 since cam 14 is secured to a release linkage on wire pulling head 18. Valve 19 controls upward (backward) motion and is the actuating valve that moves transfer arms 12 to the wire pickup position. Valve 19 engages wire pulling head 18 via cam follower 20 through lateral cam 20*a* and is activated by the return of the wire pulling head to the start of the pull cycle. Wire pulling head 18 rides on guide track 21 and has secured thereto wire pulling head gripper 22 which opens and closes to bring wire 17 into contact with the wire cutting and stripping die that includes cutting and stripping blades 23*a*. FIG. 2*a* also illustrates actuator bar 24 which actuates gripper jaws 13 on transfer arms 12 so that they can open and release completed wire conductor 25. As shown, actuator bar 24 responds to the movement of the cutting and stripping die 22.

Figure 2B:
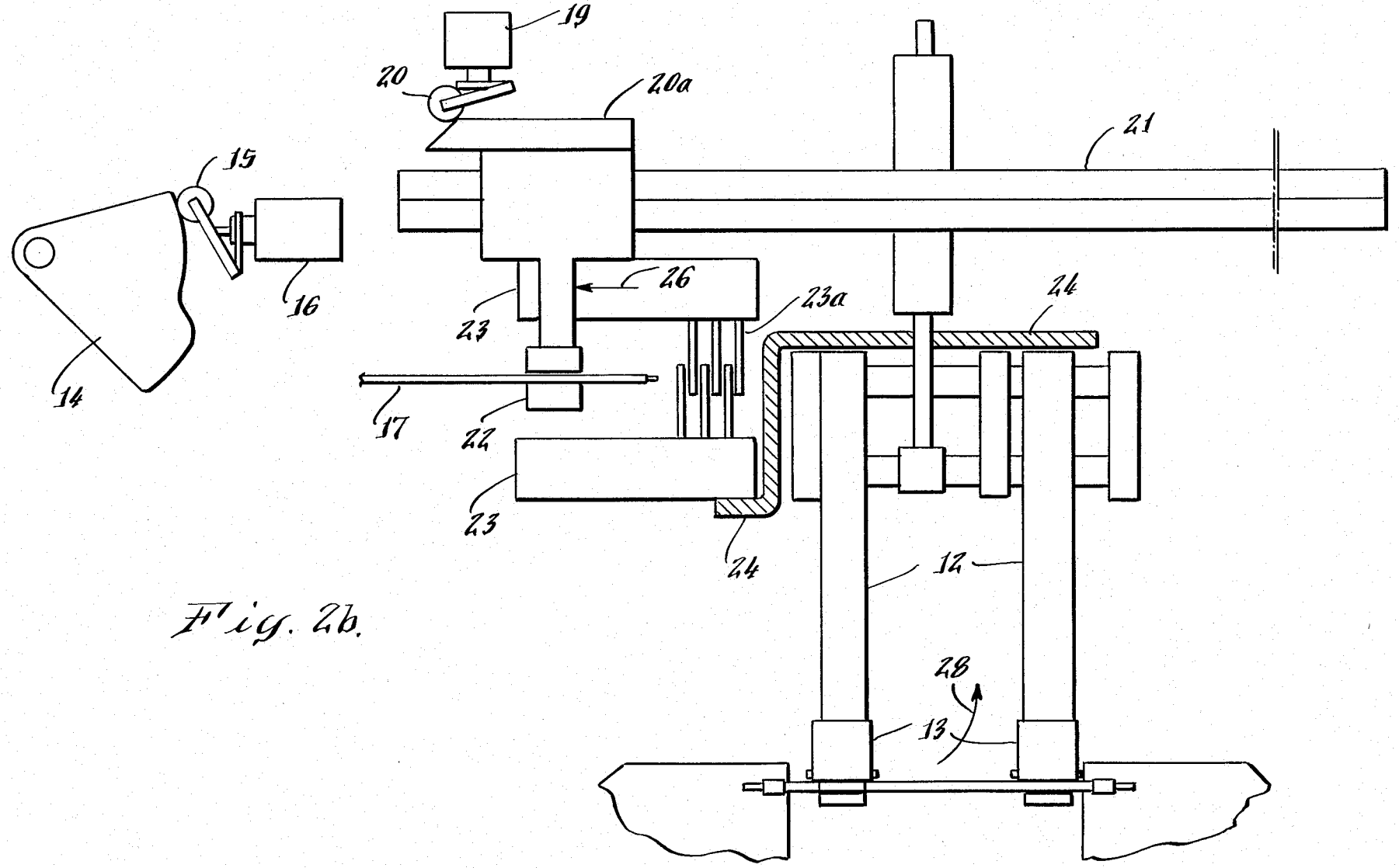
Figure 2C:
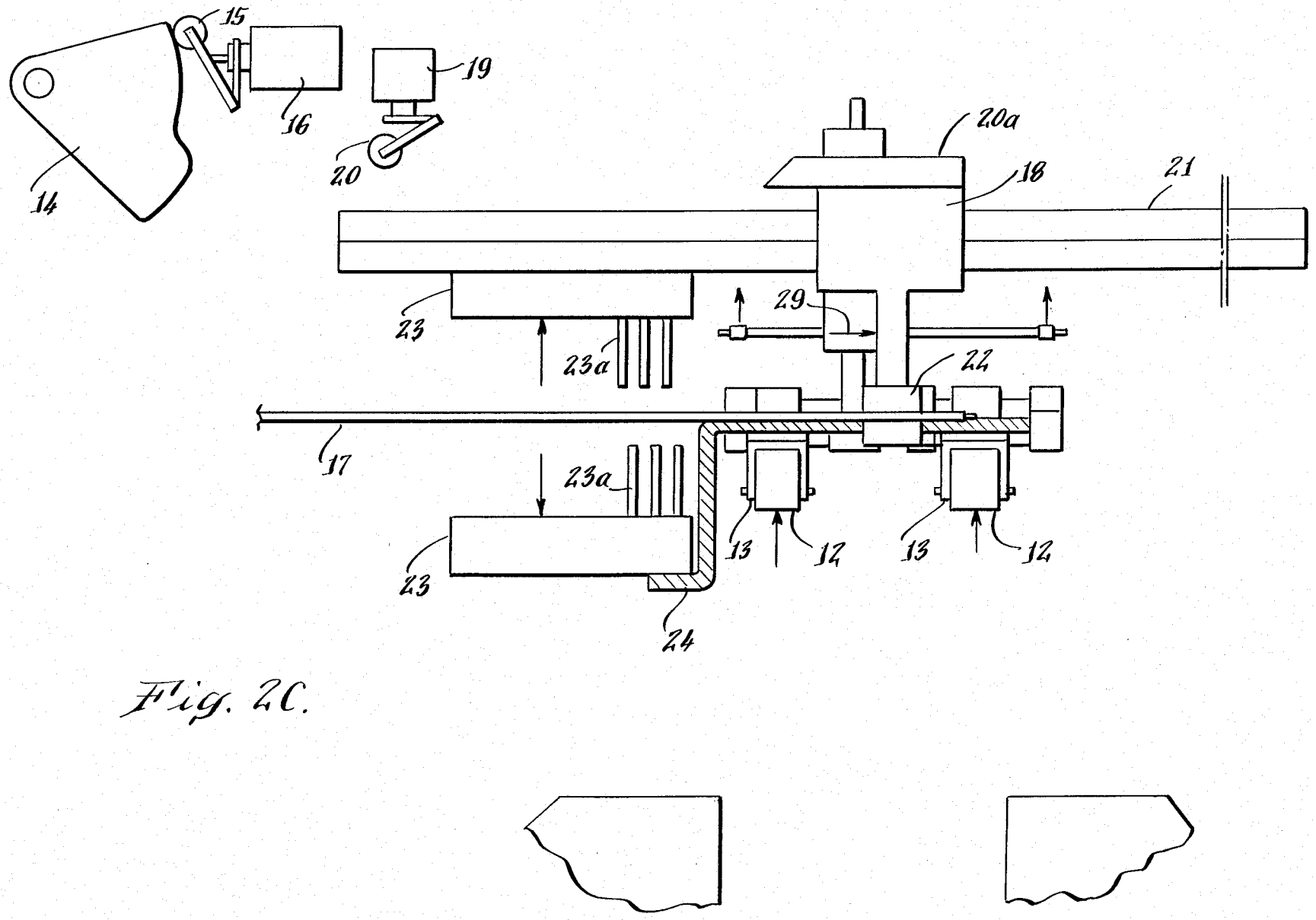
Figure 2D:
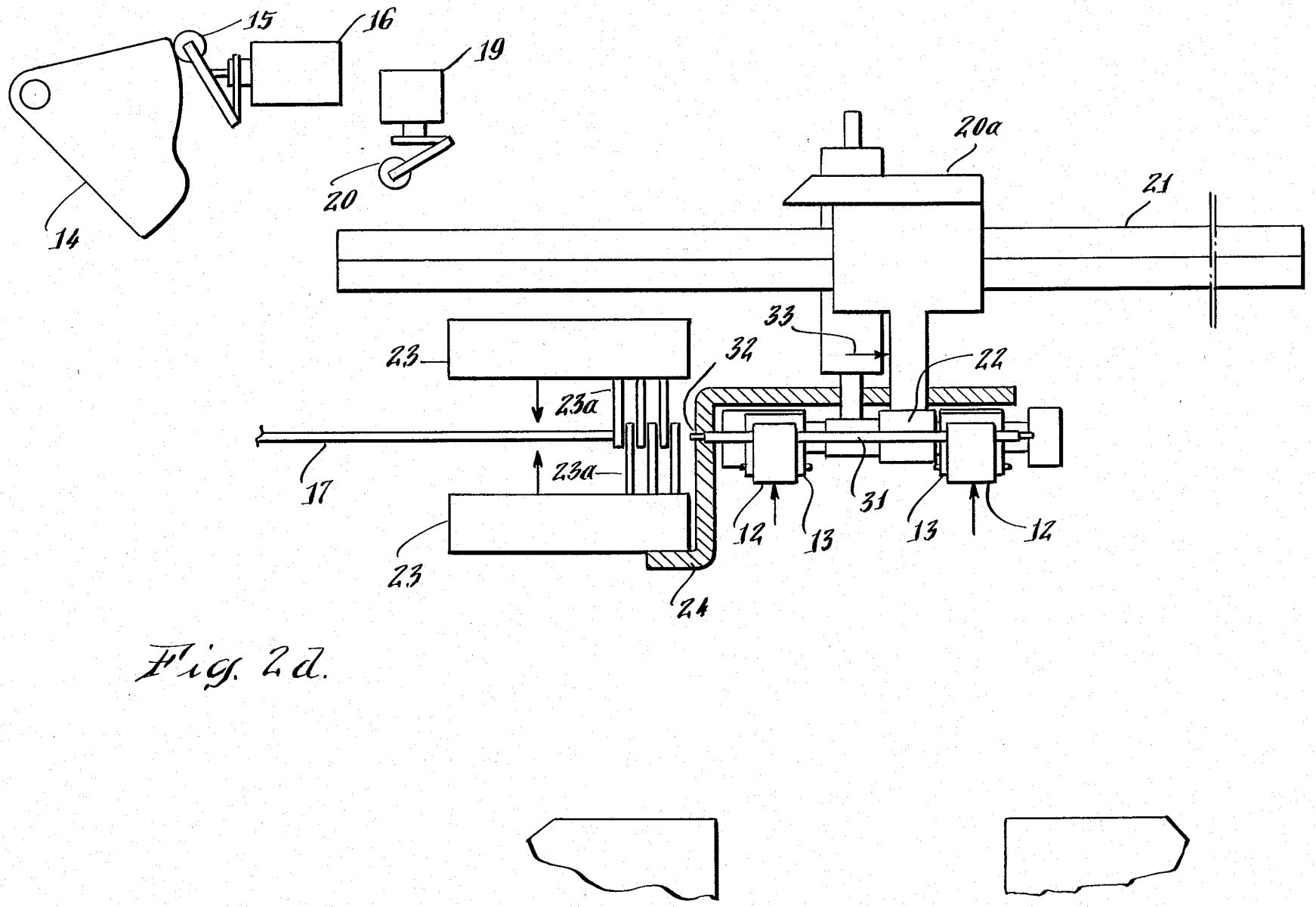
Figure 2E:
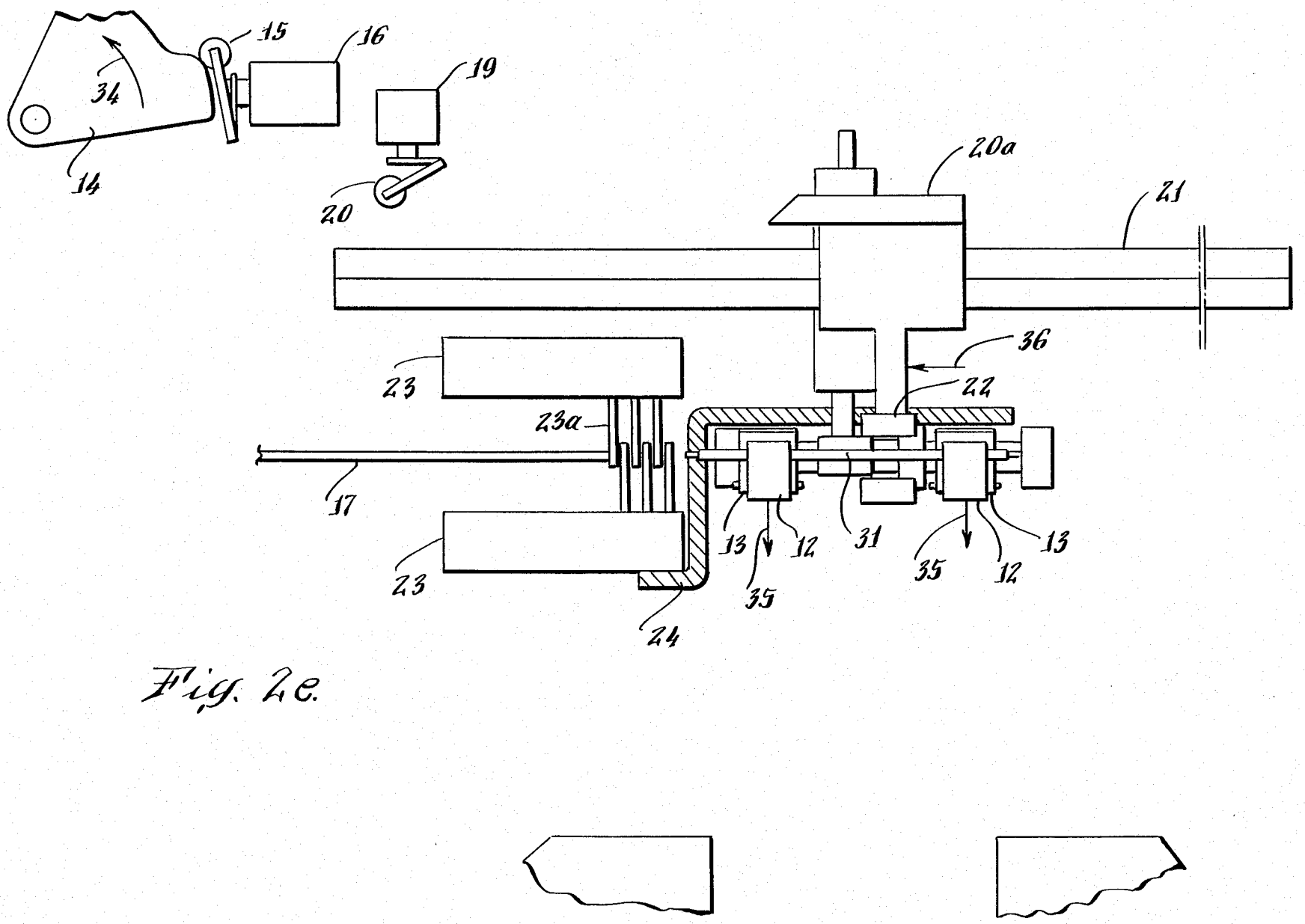
Figure 2F:
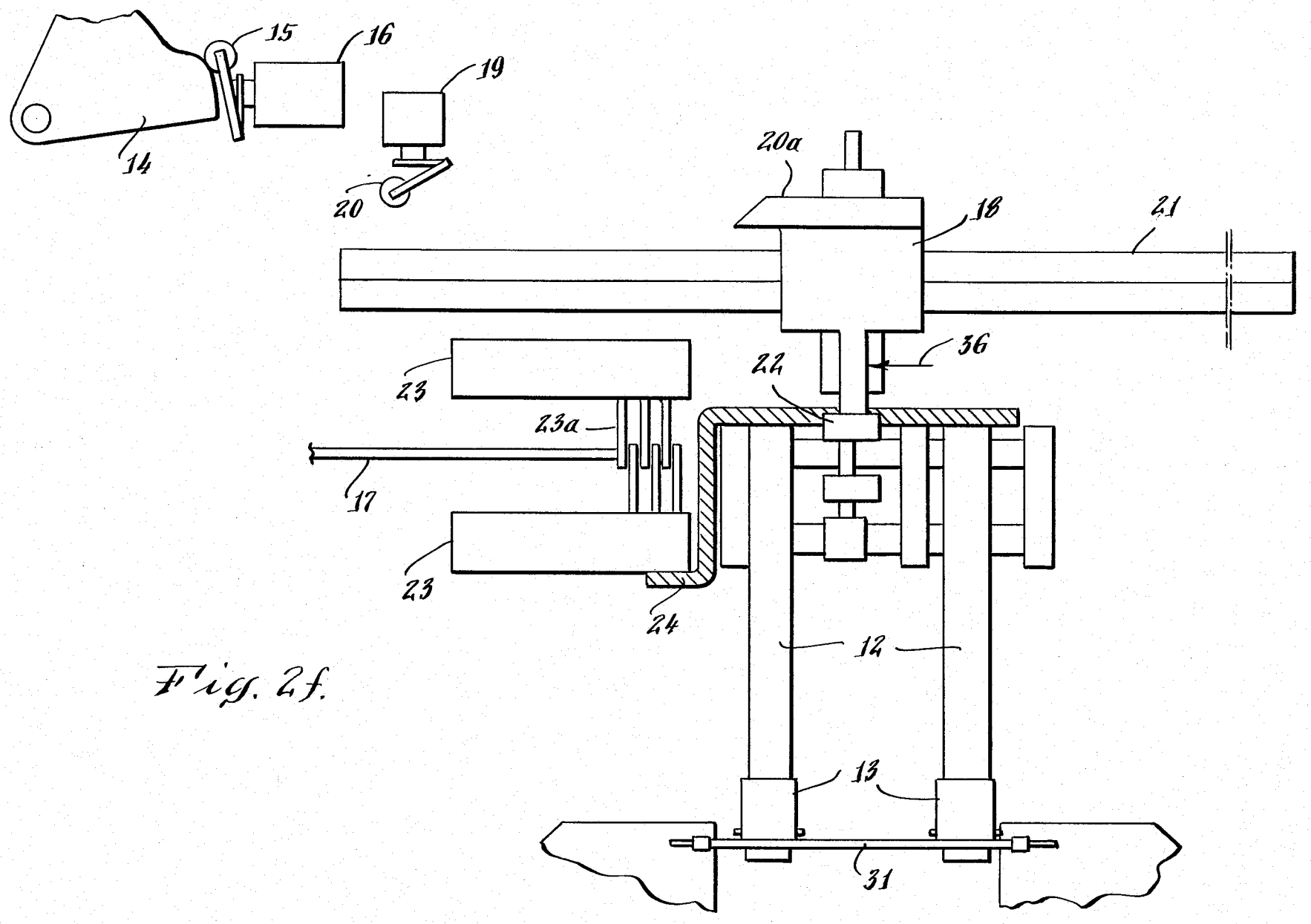
Figure 2G:
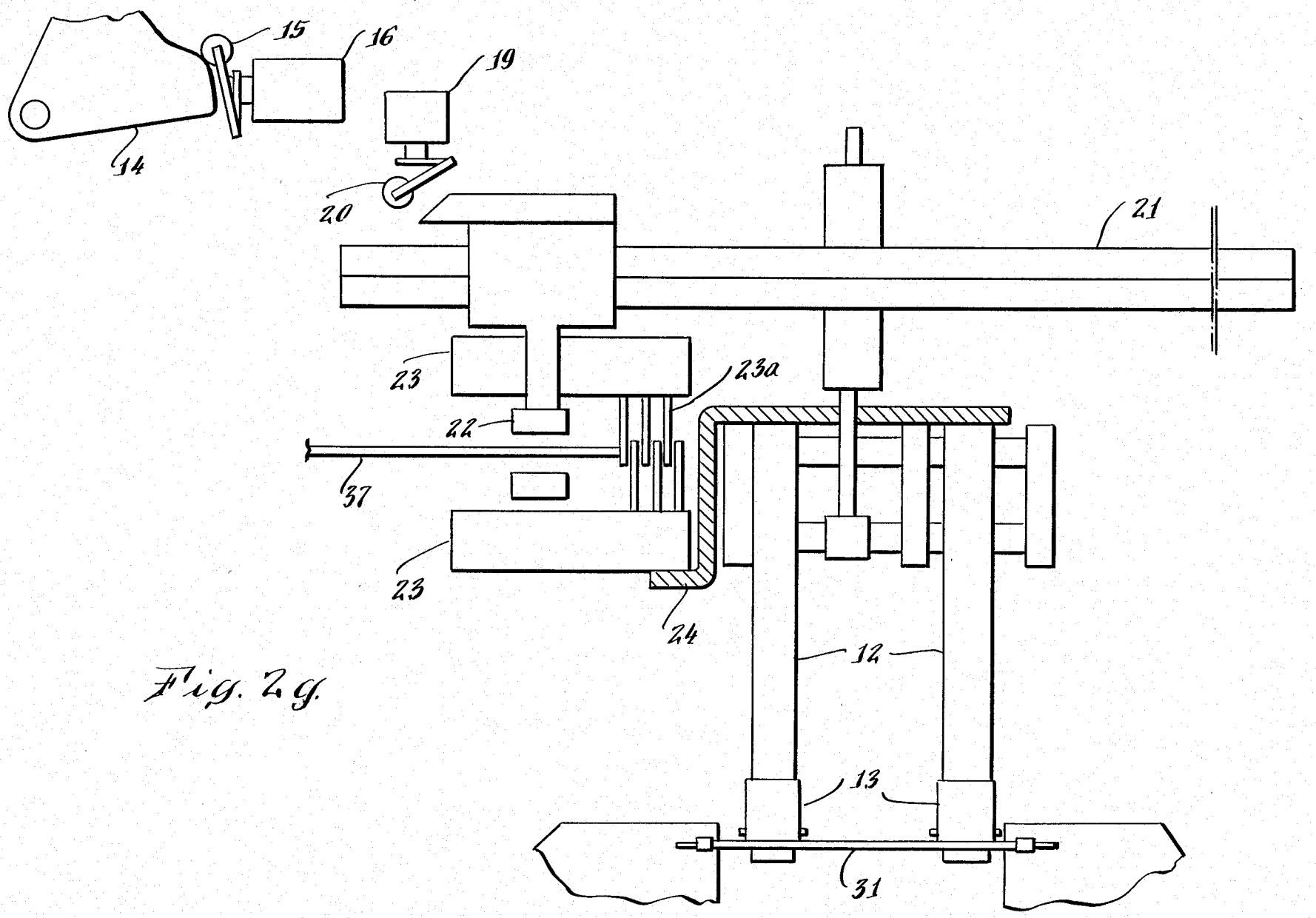
Figure 2H:
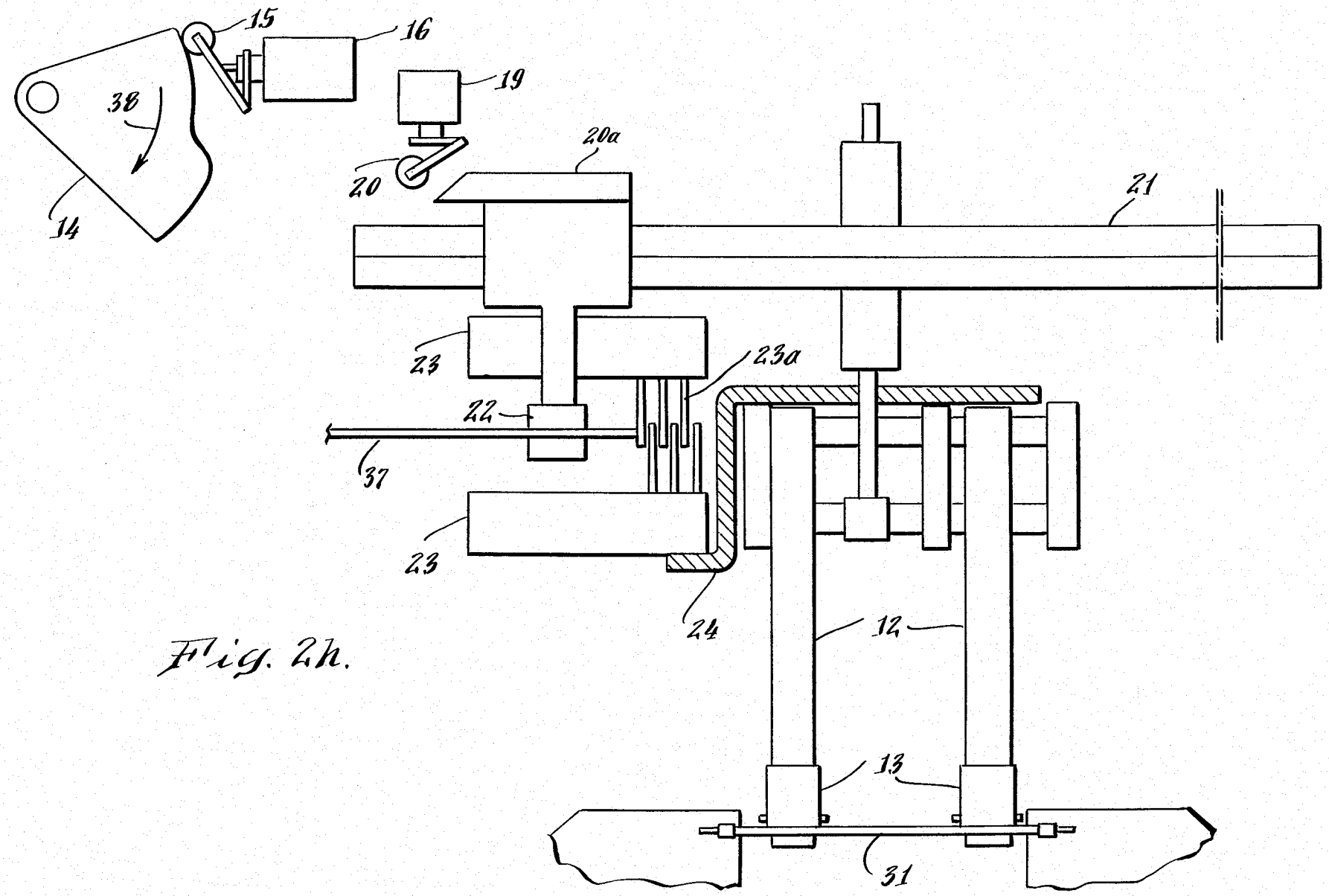

As wire pulling head 18 backs up in the direction shown by arrow 26 (FIG. 2*b*) to strip wire 17 secured in grippers 22, lateral cam 20*a* through cam follower 20 trips valve 19. This movement in turn causes transfer arms 12 to start moving in an upward direction as shown by arrow 28. Also, as wire pulling head 18 is backed up, wire cutting and stripping die set 23 moves to an open position which in turn moves actuator bar 24 into position as shown in FIG. 2*c*. Wire pulling head 18 moves along guide track 21 and continues across the guide track in the direction of arrow 29 until the required length of wire 17 has been pulled into position. Concurrently therewith, transfer arms 12 swing into the intermediate position as shown, restrained by actuator bar 24. As illustrated in FIG. 2*d* wire pulling head 18 stops at the point where the required length of wire 17 has been pulled. When the pulling head stops moving, cutting and stripping die 23 with blades 23*a* closes in the direction of arrows 30 allowing actuator bar 24 to move in. As the actuator bar moves in, transfer arms 12 move toward the wire pick-up position. The cutting and stripping die closes fully which in turn moves the actuator bar in fully thereby allowing gripper jaws 13 to grip length of wire 31. After the gripper jaws grip wire 31, wire pulling head 18 moves to the far right position in the direction of arrow 33 to strip the other end 32 of wire 31. After reaching its far right position the wire pulling head gripper 22 releases wire 31. After the wire pulling head releases the wire it starts moving back in the direction of arrow 36 (FIG. 2*e*). As wire 31 is released, quadrant cam 14 that is mounted to a linkage (not shown) controlling wire pulling head 18, rotates in the direction of arrow 34 tripping valve 16 which in turn controls the downward motion of transfer arms 12. After valve 16 is operated, the transfer arms swing down in the direction of arrows 35 to the crimp position. Thereafter wire pulling head continues to move back on guide track 21 in the direction of arrow 36 (FIG. 2*f*) to the point where it can once again pick up the wire. Transfer arms 12 swing completely down to the crimp position. Upon swinging down in this position transfer arms 12 trip a microswitch which in turn starts a cam (not shown) that trips an air valve which moves a small air cylinder to eject wire 31. Thereafter, and as illustrated in FIG. 2*g* wire pulling head 18 is in the position as shown, stops moving, and is ready to have its gripper 22 close on wire 37. FIG. 2*h* illustrates how pulling head gripper 22 closes on wire 37. As this occurs quadrant cam 14 rotates in the direction of arrow 38 back to the static position as illustrated in FIG. 2*a*, which the system is now in. The entire operation as described hereinabove then repeats itself in the sequence as described.

Figure 3:
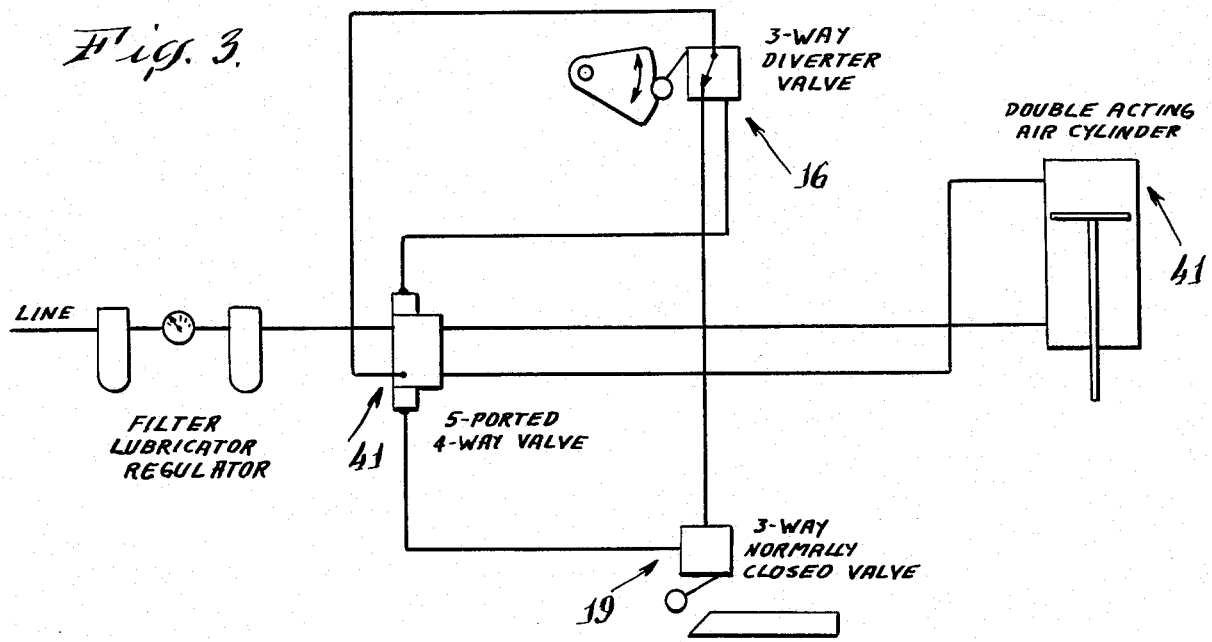
FIG. 3 illustrates a preferred embodiment of an air flow diagram for operating the automatic wire transfer mechanism in accordance with the present invention.

Referring now to FIG. 3, there is shown a preferred embodiment of an air flow diagram for operating the automatic wire transfer mechanism in accordance with the present invention including valves 16, 19, and 40, and double acting air cylinder 41.

While this invention has been described in conjunction with the embodiment described herein, it is evident that many alternatives, modifications and variations will be apparent to those skilled in the art. Accordingly, the present invention is intended to embrace all such alternatives, modifications and variations and fall within the spirit and scope of the appended claims.

What is claimed is:

1. In an automated system for the manufacture of electrical components which includes a wire cutting station, a wire stripping station and a crimping press, the improvement comprising:

a wire transfer mechanism which is adapted for automatic cyclic operation in conjunction with a wire cutting apparatus, a wire stripping apparatus and a crimping press, said transfer mechanism having a base positionable relative to a wire feed assembly and a wire crimping assembly;

a plurality of transfer arms pivotably mounted on said base;

means for coordinated movement of said transfer arms between a wire pickup station of said wire feed assembly and said wire crimping press;

releasable gripper means including a notch structure operatively associated with the proximate end of each transfer arm for engaging a length of wire at the wire pick-up station so as to prevent relative motion of the wire in a direction normal to the direction of the wire and yet allowing for the axial movement thereof;

said gripper means adapted for receiving a length of wire from the pick-up station of the wire feed assembly, transferring said length of wire directly to said crimping station, andd thereafter releasing said length of wire, upon the return stroke of the transfer arm, at a wire collection station; and actuator means, for performing in repeatable sequence, the pick-up, transfer, and release of the length of wire from the gripper means and the repetition of such cycle whereby, the receiving, transfer and release of said length of wire by said gripper means of the wire transfer mechanism is performed without bending of the length of wire.

2. A wire transfer mechanism according to claim 1 including a pair of transfer arms, each of the arms along with said gripper means positioned for gripping proximate an end portion of a length of wire.

3. A wire transfer mechanism according to claim 1 wherein said means for moving said transfer arm includes two control valves, one of the valves controlling the backward motion and the other valve controlling the forward motion of the arm.

4. A wire transfer mechanism according to claim 1 wherein said releasable gripper means is a pair of jaws.

5. The wire transfer mechanism of claim 1 wherein the release of the length by wire gripper means is effected by opening of said gripper means during deceleration of the transfer arms on the return stroke thereby allowing for the momentum of the wire to carry it from said gripper means to a wire collection station.

* * * * *